US011067287B2

(12) United States Patent
Lee

(10) Patent No.: US 11,067,287 B2
(45) Date of Patent: Jul. 20, 2021

(54) OVEN

(71) Applicant: SAMSUNG ELECTRONICS CO., LTD., Suwon-si (KR)

(72) Inventor: Dong-ho Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 251 days.

(21) Appl. No.: 16/099,907

(22) PCT Filed: Jun. 5, 2017

(86) PCT No.: PCT/KR2017/005853
§ 371 (c)(1),
(2) Date: Nov. 8, 2018

(87) PCT Pub. No.: WO2017/209582
PCT Pub. Date: Dec. 7, 2017

(65) Prior Publication Data

US 2019/0178500 A1 Jun. 13, 2019

(30) Foreign Application Priority Data

Jun. 3, 2016 (KR) ..... 10-2016-0069696

(51) Int. Cl.
*F24C 7/08* (2006.01)
*F24C 15/00* (2006.01)
*F24C 15/20* (2006.01)

(52) U.S. Cl.
CPC ..... *F24C 7/081* (2013.01); *F24C 15/006* (2013.01); *F24C 15/2007* (2013.01)

(58) Field of Classification Search
CPC ..... F24C 7/081; F24C 7/082; F24C 15/006; F24C 15/2007; F24C 15/2014;
(Continued)

(56) References Cited

U.S. PATENT DOCUMENTS 3,027,444 A 3/1962 Weeks
3,499,431 A * 3/1970 McArthur, Jr. ..... F24C 14/025 126/39 R
(Continued)

FOREIGN PATENT DOCUMENTS

DE 10 2004 003 409 8/2005
EP 1 619 443 1/2006
(Continued)

OTHER PUBLICATIONS

European Office Action dated Apr. 10, 2019 from European Patent Application No. 17807075.1, 9 pages.
(Continued)

*Primary Examiner* — Shawntina T Fuqua
(74) *Attorney, Agent, or Firm* — Staas & Halsey LLP

(57) ABSTRACT

Disclosed is an oven having a sensor for sensing the air inside a cooking chamber so as to enable the cooked state of food materials to be recognized. The disclosed oven comprises: the cooking chamber; a first passage part disposed outside the cooking chamber so as to communicate with the cooking chamber; the sensor disposed inside the first passage part; a second passage part isolated from the first passage part, and through which forcibly suctioned external air is transferred; and an inlet and an outlet, which allow the first and second passage parts to communicate with each other, wherein, when the inlet is closed, the air inside the cooking chamber flows into the first passage part, and then passes through the sensor so as to be discharged through the outlet, and when the inlet is opened, the air flowing from the second passage part to the first passage part through the inlet passes through the sensor together with the air flowing into the first passage part from the inside of the cooking chamber so as to be discharged through the outlet.

16 Claims, 9 Drawing Sheets

(58) Field of Classification Search
CPC .... F24C 15/2042; F24C 14/025; F24C 14/02; F24C 14/00; F24C 3/087; F24C 3/16
See application file for complete search history.

(56) References Cited

U.S. PATENT DOCUMENTS

| | | | |
|---|---|---|---|
| 4,587,393 | A | 5/1986 | Ueda |
| 5,395,633 | A | 3/1995 | Lee |
| 5,402,709 | A | 4/1995 | Carron et al. |
| 2011/0214661 | A1 | 9/2011 | Hyun et al. |
| 2015/0241069 | A1 | 8/2015 | Brant et al. |

FOREIGN PATENT DOCUMENTS

| | | |
|---|---|---|
| EP | 2 439 455 | 4/2012 |
| EP | 2 687 787 | 1/2014 |
| JP | 2010-38368 | 2/2010 |
| JP | 2013-29229 | 2/2013 |
| JP | 2016-50697 | 4/2016 |
| KR | 0142501 | 4/1998 |
| KR | 0186405 | 12/1998 |
| KR | 2001-0108981 | 12/2001 |
| KR | 10-2007-0108298 | 11/2007 |
| KR | 10-2011-0087928 | 8/2011 |
| KR | 10-2011-0099541 | 9/2011 |

OTHER PUBLICATIONS

English Translation of International Search Report dated Sep. 4, 2017 in corresponding International Patent Application No. PCT/KR2017/005853, 2 pages.

Written Opinion of the International Searching Authority dated Sep. 4, 2017 in corresponding International Patent Application No. PCT/KR2017/005853, 15 pages.

Korean Office Action dated Apr. 23, 2020 from Korean Application No. 10-2016-0069696, 12 pages.

Korean Notice of Allowance dated Oct. 29, 2020 from Korean Application No. 10-2016-0069696, 6 pages.

* cited by examiner

OVEN

CROSS-REFERENCE TO RELATED APPLICATIONS

This application is a National Phase Application under 35 U.S.C. § 371 of PCT International Patent Application No. PCT/KR2017/005853, filed Jun. 5, 2017, which claims the foreign priority benefit under 35 U.S.C. § 119 to Korean Patent Application No. 10-2016-0069696 filed Jun. 3, 2016, the contents of which are incorporated herein by reference.

FIELD OF THE INVENTION

Devices and methods consistent with what is disclosed herein relate to an oven, and more particularly, to an oven having a simple structure and comprising a cooking condition sensor that is applicable at a high temperature cleaning mode.

DESCRIPTION OF THE RELATED ART

An oven is a cooking equipment for closing, heating and cooking a cooking material, and typically there are three types of ovens such as an electric type, a gas type, and an electronic type depending on heat source. The electric type oven uses an electric heater as the heat source, and the gas type oven and the microwave use heat due to gas and frictional heat of water molecules due to high frequency, respectively.

Conventionally when cooking food using an oven, a user puts food (e.g., cooking materials) into a cooking chamber, closes the door, and inputs a cooking time through a timer button. A heater provided in the oven operates during the set cooking time to heat the food contained in the cooking chamber.

When using the oven, the user manually inputs the cooking time according to the type and condition of food in the cooking chamber. However, the user determines the cooking time differently according to the type and condition of food. Therefore, a problem rises in that food cannot be always cooked to a certain degree. In addition, it is bothersome for the user to check whether pre-heating is completed and whether the food is cooked every time after putting the food into the cooking chamber.

In order to solve such problem, a sensor is provided in the oven to sense how well the food is being cooked. The oven with the sensor is mounted with a separate sensor accommodating pipe connected to the cooking chamber so that air in the cooking chamber is exposed in the small amount in addition to an exhaust pipe, and the sensor is provided in the sensor accommodating pipe. The sensor senses air discharged from the cooking chamber, and transmits a sensing signal to a controller of the oven, and the controller determines the current cooking condition so that automatic cooking is possible. However, the oven in the related art has the following problem.

In order to provide the separate sensor accommodating pipe for the sensor, a separate discharging pipe, a plurality of brackets, and the like are required. Thus, the structure becomes complicated and material cost increases, which makes it difficult to apply to a product. Also, since the sensor accommodating pipe requires an additional, the size of the oven is not compact.

The sensor accommodating pipe with sensor is fixed to the cooking chamber by die casting, and exposed to heat due to direct heat transfer according to the operation of the oven.

As the temperature of the sensor accommodating pipe increases, heat of high temperature is continuously transmitted to the sensor, which shortens the life of the sensor.

In addition, in the case of pyrolytic cleaning performed at a temperatures (approximately 400 degree to 500 degree) which is higher than heat generated during cooking, the sensor accommodating pipe cannot be applied to the oven due to high temperature heat.

SUMMARY

An aspect of the embodiments relates to providing an oven with a simple structure including a sensor for automatic cooking to reduce manufacturing cost, and to which a sensor is applied even at a high temperature cleaning mode.

According to an embodiment, there is provided an oven including a cooking chamber, a first passage part arranged outside the cooking chamber and tunneled with the cooking chamber, a sensor arranged in the first passage part, a second passage part separated from the first passage part, and through which forcibly suctioned external air is transferred, and an inlet and an outlet configured to allow the first and second passage parts to be tunneled with each other, wherein based on the inlet being closed, air in the cooking chamber flows into the first passage part, and then passes through the sensor to be discharged through the outlet, and based on the inlet being opened, air flowing from the second passage part into the first passage part through the inlet passes through the sensor to be discharged through the outlet together with the air in the cooking chamber which flows into the first passage part.

The second passage part may have a portion adjacent to the outlet that is narrower than a portion adjacent to the inlet.

A cross-section of the second passage part may gradually decrease from the inlet towards the outlet.

The second passage part may include a main inlet into which external air is forcibly suctioned, and a main outlet through which air transferred from the first and second passage parts is discharged.

The main inlet may be mounted with a blowing fan.

The sensor may be disposed downstream of a cooking chamber outlet which discharges air in the cooking chamber or the inlet on an air flow path along the first passage part.

The outlet may be disposed downstream of the sensor on the air flow path along the first passage part.

The oven may further include an opening and closing member configured to open and close the inlet; and an actuator configured to drive the opening and closing member.

An area of the inlet may be smaller than an area of the outlet.

The sensor may be movably disposed to one of the first and second passage parts.

The sensor may be configured to open and close the inlet.

The first passage part may be formed between a first duct and a partition, and wherein the second passage part is formed between a second duct and a partition.

The partition may be formed in a way that a portion including the inlet is inclined downwardly to one side.

According to an embodiment, there is provided an oven including a cooking chamber, a first duct arranged outside the cooking chamber and tunneled with the cooking chamber, a sensor arranged in the first duct, a partition coupled to the first duct, the partition including an inlet into which external air flows, and an outlet which discharges air in the first duct, and a second duct coupled to the partition, the second duct including a main inlet into which external air is forcibly suctioned, and a main outlet which discharges internal air, wherein air in the cooking chamber flows into the first duct, and passes through the sensor to be discharged through the outlet at a cooking mode, and passes through the sensor to be discharged through the outlet together with air flowing into the first duct from the second duct through the inlet at a cleaning mode.

The sensor may be disposed in a space through which air in the cooking chamber and air flowing from the inlet flow together.

DETAILED DESCRIPTION OF EXEMPLARY EMBODIMENTS

Figure 1:
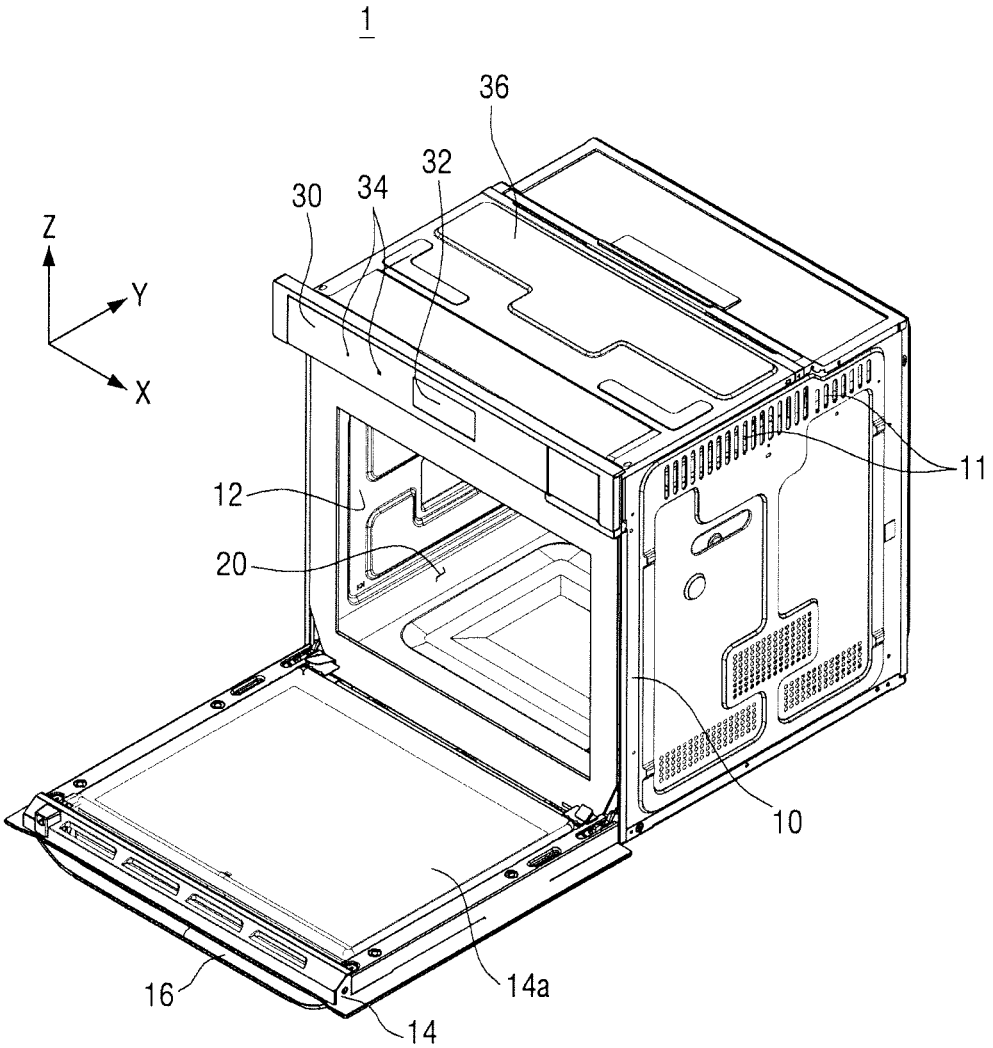
FIG. 1 is a perspective view illustrating an oven according to an embodiment of the present disclosure.

While the present disclosure has been described with reference to embodiments, it is to be understood that the present disclosure is not limited to the embodiments. It is intended to cover various modifications and equivalent arrangements included within the spirit and scope of the appended claims. In the following, it is exemplified that the present disclosure can be implemented as described in the embodiments.

Therefore, it is intended that the present disclosure covers the modifications and variations of this disclosure provided within the scope of the appended claims and their equivalents. In order to facilitate understanding of the embodiments to be described below, in the reference numerals shown in the accompanying drawings, among the components having the same function in each embodiment, the related components are denoted by the same or an extension line number.

A built-in type oven will be exemplified for an electronic product according to an embodiment of the present disclosure, but the present disclosure is applied to an oven other than a built-in type, and it is clearly understood that the present disclosure can be applied to a microwave. FIG. 1 is a perspective view illustrating an oven according to an embodiment of the present disclosure.

Referring to FIG. 1, an oven 1 may include an outer case 10 for forming the outside of the oven, and a cooking chamber 20 for storing food therein.

The cooking chamber 20 may be arranged inside the outer case 10, and formed in a cube shape approximately by an inner case 12 with its open front face. The open front face of the cooking chamber 20 may be selectively opened and closed by a door 14 which is rotatably coupled to the outer case 10.

The door 14 may be provided with a handle 16 at its upper part so that a user can easily open the door 14. In addition, the door 14 may be mounted with a door glass 14A so that the user can check the condition of the cooking chamber 20 with naked eyes.

Although not shown, a plurality of guide rails may be arranged on both sides of the cooking chamber 20 to use the space effectively by splitting the space of the cooking chamber 20, and a rack on which food or a food container is placed may be detachably coupled to each guiderail. A heater (not shown) for heating the food on the rack may be mounted on an upper surface of the cooking chamber 20. A circulation fan (not shown) for circulating air in the cooking chamber 20 may be mounted on a rear surface of the cooking chamber 20. The circulation fan may maintain the temperature in the cooking chamber 20 to be uniform so as to make it possible to cook quickly.

A machine room may be provided at the upper part of the cooking chamber 20. To be specific, the machine room may be formed between the upper part of the inner case 12 and a cover 36, and separately provided from the cooking chamber 20. The machine room may be provided with various types of electric parts (not shown) such as a circuit board necessary for the operation of the oven 1. A front surface panel 30 may be provided on the front surface of the machine room. The front surface panel 30 may include a display unit 32 for displaying the cooking condition of the oven 1 and the operation state of the user, and a button unit 34 for receiving a user command for controlling the operation of the oven 1.

Figure 2:
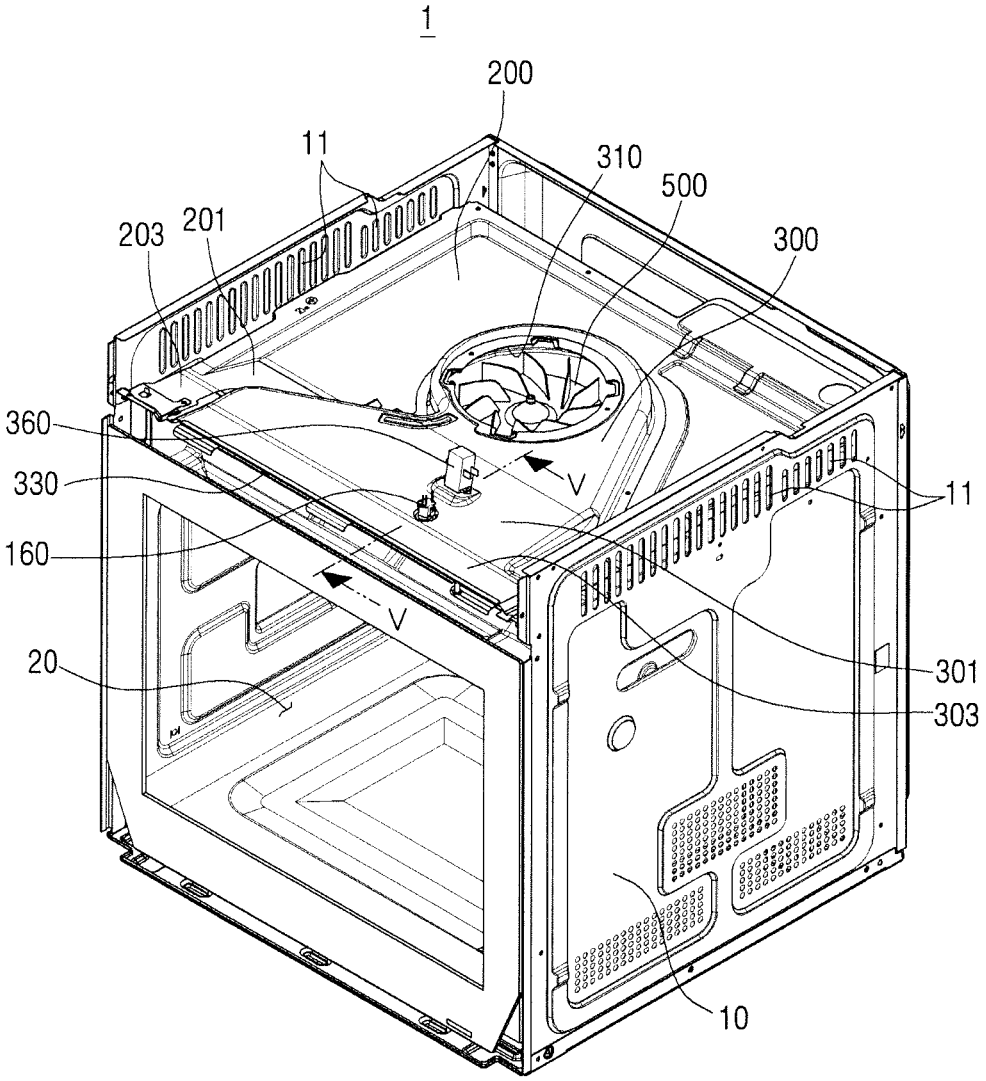
FIG. 2 is a perspective view illustrating an oven without a door and a cover.
Figure 3:
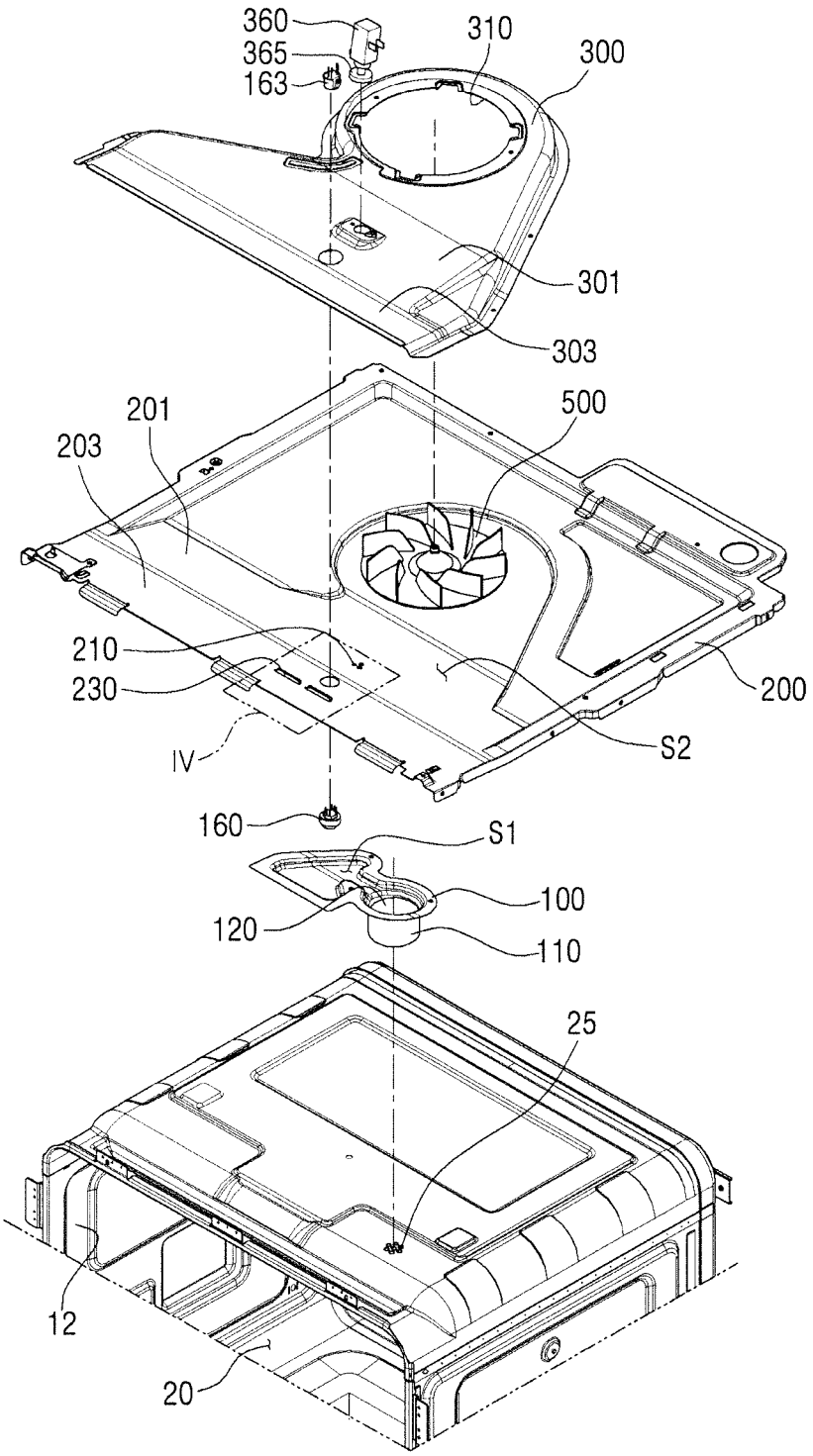
FIG. 3 is an exploded perspective view illustrating upper configuration of an oven.

FIG. 2 is a perspective view illustrating an oven without a door and a cover, and FIG. 3 is an exploded perspective view illustrating upper configuration of an oven.

Referring to FIGS. 2 and 3, the machine room provided outside the cooking chamber 20 may include a first duct 100 arranged outside the cooking chamber 20 and tunneled with the inside of the cooking chamber 20, a second duct 300 to which forcibly suctioned external air is transferred, a partition 200 for splitting the first and second ducts 100 and 300, and a blowing fan 500 which suctions and blows external fluid. A plurality of electric parts (not shown) may be mounted on the upper surface of the partition 200 to perform cooking and cleaning operations of the oven 1.

The blowing fan 500 may be arranged on a rear unit of the machine room. The external air of the oven 1 may be suctioned into the machine room through an external hole 11 formed on the outer case 10. The blowing fan 500 may cool the inside of the machine room by suctioning the external air by a centrifugal fan, and forcibly blow hot air in the machine room to the outside of the oven 1 through a main outlet 330. In this case, air in the cooking chamber 20 may be selectively discharged to the outside of the cooking chamber 20 through the main discharging unit 300. The structure for discharging the air in the cooking chamber 20 will be described in detailed with reference to the following drawings.

Referring to FIG. 3, as described above, the first duct 100, the partition 200, the second duct 300 may be stacked vertically on the outside of the upper part of the cooking chamber 20. In other words, the first duct 100 may be coupled to the bottom surface of the partition 200, and the second duct 300 may be coupled to the upper surface of the partition 200, so that a space where air flow upwardly or downwardly from the partition 220 is formed. The space through which air flows may be provided by a first passage part S1 (see FIG. 5) formed by coupling the first duct 100 and the partition 200, and a second passage part S2 (see FIG. 5) formed by coupling the second duct 300 and the partition 200.

The cooking chamber 20 may be provided with a cooking chamber outlet 25 connected to the inside of the cooking chamber 20 to discharge air in the cooking chamber 20 on the upper surface of the inner case 12 that forms the cooking chamber 20. The cooking chamber outlet 25 may include a plurality of cooking chamber outlets.

One end of the first duct 100 may be coupled to the partition 200 to form the first passage part S1. In this case, a sensor 160 may be arranged in the first passage part S1 (see FIG. 5). An exhaust pipe 120 may be formed on the other end of the first duct 100, and a first extension pipe 110 extending downwardly from the exhaust pipe 120 and tunneled with the cooking chamber outlet 25 may be formed.

The first extension pipe 110 may be coupled to the cooking chamber outlet 25. Accordingly, air discharged from the cooking chamber 20 may be guided to the first passage part S1 through the exhaust pipe 120. It is desirable that a space between the first extension pipe 110 and the cooking chamber outlet 25 is sealed so that air in the cooking chamber 20 may flow into the first duct 100 through the exhaust pipe 120 along the first extension pipe 110.

The sensor 160 may sense the cooking condition of the food in the cooking chamber 20 by sensing the air discharged from the inside of the cooking chamber 20, and automatically cook the food. Therefore, the sensor 160 may be disposed in the first passage part S1 to sense air heated in the cooking chamber 20. To be specific, the sensor 160 may be disposed downstream of the cooking chamber outlet 25 on an air flow path from the exhaust pipe 120 to the outlet 230 of the partition 200 along the first passage part S1.

Since the structure of the first duct 100 with the sensor 160 is simple, and additional constituent components are not necessary for forming the first duct 100. Thus, material costs can be saved. The first duct 100 may be part of the discharging structure for discharging air in the cooking chamber 20, and there is no need for an additional space for accommodating the sensor 160. Therefore, it is advantageous to effectively use a space with the entire oven sized being maintained.

The sensor 160 may output cooking condition data on the food in the cooking chamber 20 to a controller (not shown) by sensing air flowing into the cooking chamber 20. According to the cooking condition sensed by the sensor 160, a heater (not shown) in the cooking chamber 20 may be ignited by a control signal of a controller to heat the food, and cooking may be completed by the control signal of the controller.

The sensor 160 may be a vapor sensor for sensing humidity of air generated in the cooking chamber 20 during cooking, or a temperature sensor for sensing a temperature.

The first duct 100 may be coupled to the bottom surface of the partition 200, and the second duct 300 may be coupled to the upper surface of the partition 200, which is opposite to one end. The blowing fan 500 may be arranged in the rear unit of the partition 200, and an inlet 210 into which external air flows and an outlet 230 which discharges air in the first duct 100 may be formed in the front unit. The inlet 210 may be disposed downstream of the blowing fan 500 on the air flow path from the blowing fan 50 toward the main outlet 230, and the outlet 230 may be disposed downstream of the inlet 210.

The inlet 210 may allow part of the air forcibly flowing from the outside of the oven 1 by the blowing fan 500 and flowing through the second passage part S2 to be suctioned into the first duct 100. The external air passing through the inlet 210 may be guided to the first passage part S1, and discharged through the outlet 230 by passing through the sensor 160 together with air discharged from the cooking chamber 20 through the exhaust pipe 120. The external air passing through the inlet 210 may be mixed with the air discharged from the cooking chamber 20 (particularly, air at a cleaning mode with a higher temperature than air at a cooking mode) to reduce the temperature of the air discharged from the cooking chamber 20. Accordingly, the sensor 160 arranged in the first passage part S1 may not be exposed to high temperature air, to thereby maintain durability and prevent malfunction.

The inlet 210 may be selectively opened and closed by an opening and closing member 365 to be described below to allow external air to be suctioned into or blocked from the first passage part S1. The inlet 210 may include a plurality of inlets.

The outlet 230 may be a penetration hole where air in the first duct is discharged through the second duct 300. In other words, the outlet 230 may allow air flowing through the first passage part S1 to be discharged through the second passage part S2. The outlet 230 may include a plurality of outlets.

One end of the second duct 300 may be engaged with the partition 200 to form the second passage part S2. One side of the second duct 300 may be formed in a round shape to surround the outer surface of the blowing fan 500, and include a main inlet 310 through which external air is forcibly suctioned on its upper part, and the main outlet 330 through which air in the first duct 100 and the second duct 300 is discharged on the other side, which is opposite to one side. The main inlet 310 may be formed to have a circular cross-section toward the upper surface of the second duct 300 where the blowing fan 500 is disposed so that external air may be suctioned by the blowing fan 500. The main outlet 330 may be formed to have a rectangular cross-section toward the side surface of the second duct 300.

The blowing fan 500 may rotate between the second duct 300 and the partition 200 since a rotational shift is fixed to the partition 200. The second duct 300 may surround the blowing fan 500 to fix a mounting position of the blowing fan 500, and at the same time, guide to discharge the air flowing from the blowing fan 500 to the outside of the oven 1 through the main outlet 330 smoothly.

Figure 4:
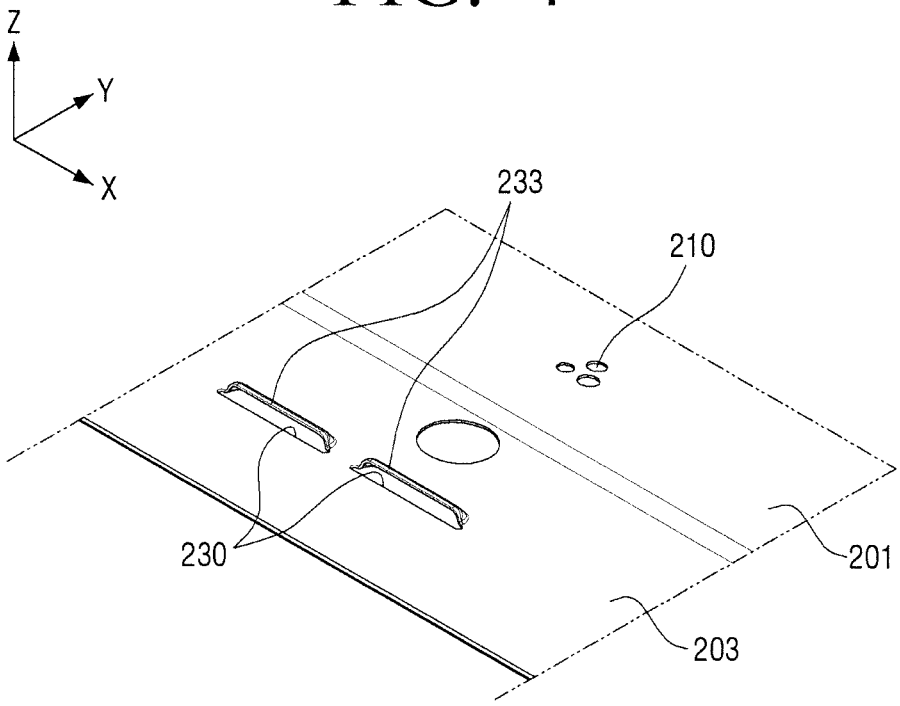
FIG. 4 is an enlarged perspective view of part IV shown in FIG. 3.

FIG. 4 is an enlarged perspective view of part IV shown in FIG. 3.

Referring to FIG. 4, the partition 200 may include a first inclined surface 201 where a portion including the inlet 210 is inclined downwardly toward one side, and a first flat surface 203 where a portion including the outlet 230 is formed flat.

The amount of air flowing into the inlet 210 may be smaller than the amount of air discharged through the outlet 230. Since the amount of air discharged through the outlet 230 is maintained to a certain amount, if the amount of air flowing into the inlet is greater than the amount of air discharged through the outlet 230, air which is not discharged may be prevented from flowing into the cooking chamber 20 and flowing backward. The amount of air flowing into the inlet 210 may be controlled according to the size of the inlet 210, and the space between the second duct 300 and the partition 200 at the position of the inlet 210. The area of the inlet 210 may be smaller than the area of the outlet 230.

The outlet 230 may be disposed downstream of the sensor 160 on an air flow path along the first passage part S1. When the inlet 210 is closed, air in the cooking chamber 20 may flow into the first passage part S1, and pass through the sensor 160 to be discharged through the outlet 230. When the inlet 210 is opened, air flowing from the second passage part S2 into the first passage part S1 through the inlet 210 may be discharged to the outlet 230 through the sensor 160 together with the air flowing from the inside of the cooking chamber 20 into the first passage part S1.

The outlet 230 may include a guide member 233 obliquely formed in the direction of the main outlet 330. The guide member 233 may guide the air discharged through the outlet 230 to the main outlet 330.

Figure 5:
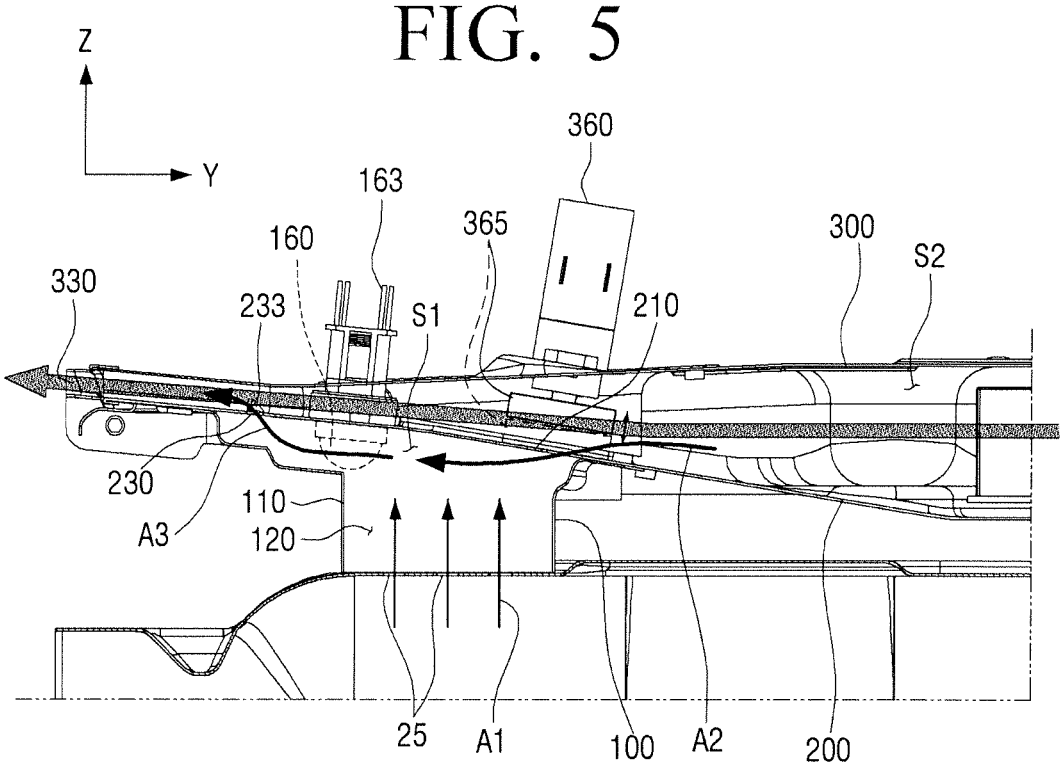
FIG. 5 is a cross-sectional view taken along line V-V shown in FIG. 2.
Figure 6:
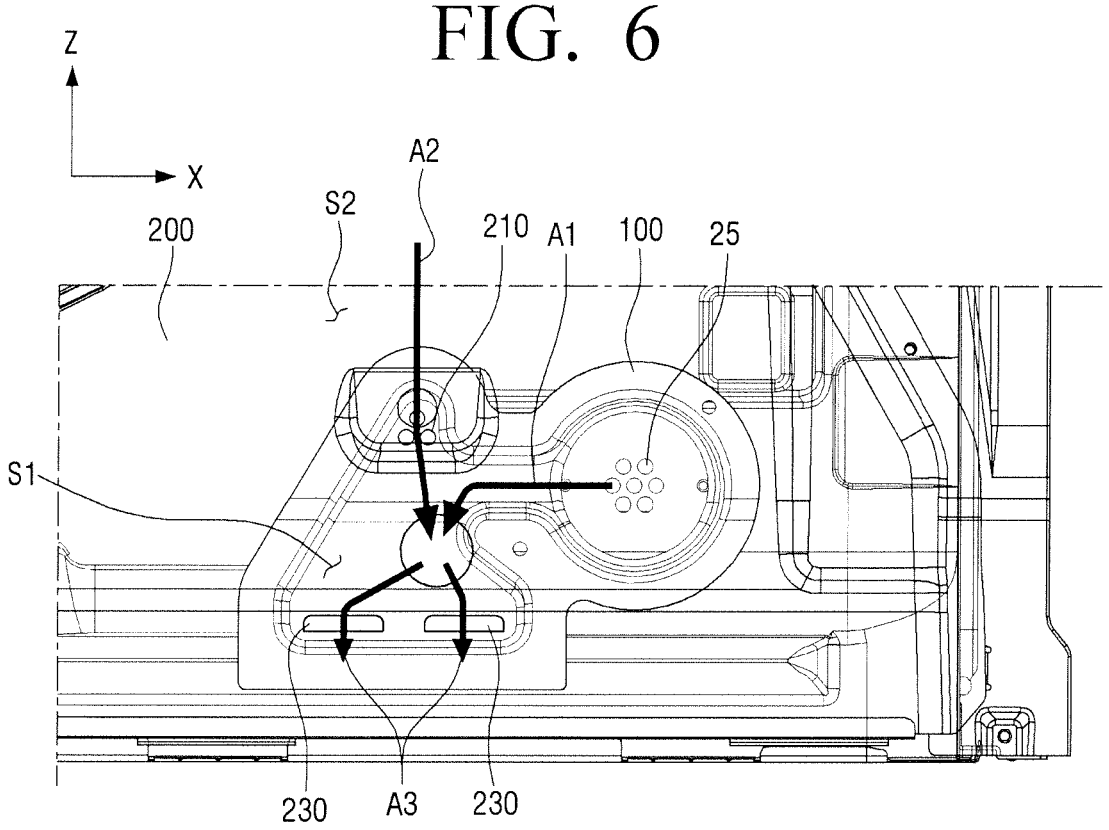
FIG. 6 is an enlarged cross-sectional view of a first duct to explain air flow in an oven according to an embodiment of the present disclosure.

FIG. 5 is a cross-sectional view taken along line V-V shown in FIG. 2, and FIG. 6 is an enlarged cross-sectional view of a first duct to explain air flow in an oven according to an embodiment of the present disclosure.

Referring to FIGS. 5 and 6, the first passage part S1 tunneled with the cooking chamber, and the second passage part S2 detached from the first passage part S1 and through which forcibly suctioned external air is transferred may be disposed outside the cooking chamber 20. The first passage part S1 and the second passage part S2 may be tunneled with each other by the inlet 210 and the outlet 230. The sensor 160 may be disposed in the first passage part S1.

The first passage part S1 may include first, second and third flow paths A1, A2 and A3. Air discharged from the cooking chamber may flow through the first flow path A1, and one end of the first flow path A1 may be tunneled with the cooking chamber outlet 25. Air flowing from the outside may flow through the second flow path A2 and one end of the second flow path A2 may be tunneled with the inlet 210. One end of the third flow path A3 may be tunneled with the outlet 230, and air of the first flow path A1 and the second flow path A2 may pass through the sensor 160 and flow through together in the third flow path A3. When the inlet 210 is closed, only the air of the first flow path A1 may flow through the third flow path A3, and when the inlet 210 is opened, air of the first flow path A1 and the second flow path A2 may be mixed and flow through together. The air flowing through the third flow path A3 may be discharged from the first passage part S1 to the second passage part S2 through the outlet 230.

Part of the air flowing into the second passage part S2 by the blowing fan 500 may flow into the second flow path A2 through the inlet 210. Air flowing into the second flow path A2 and air discharged to the first flow path A1 may flow through the third flow path A3 by pressure drop generated by air flow. The mixed air flowing through the third flow path A3 may be discharged to the second passage part S2 through the outlet 230, and discharged to the outside of the oven 1 through the main outlet 330.

The sensor 160 may be disposed in the first passage part S1, to be specific, may be disposed downstream of the exhaust pipe 120 that discharges air in the cooking chamber 20 or the inlet 210 on the air flow path along the first passage part S1. The air flowing through the first flow path A1 and the air flowing through the second flow path A2 may flow by passing through the sensor 160.

The inlet 210 may be opened or closed by an opening and closing member 365. The opening and closing member 365 may have elasticity and be formed in a size large enough to accommodate all the inlets. The opening and closing member 365 may be connected to an end of an actuator 360, and driven upwardly and downwardly by the actuator 360.

When the inlet 210 is closed, the air in the cooking chamber 20 may flow into the first flow path A1, and then to third flow path A3 by passing through the sensor 160. When the inlet 210 is opened, the air flowing from the second passage part S2 to the second flow path A2 through the inlet 210 may be discharged to the third flow path A3 by passing through the sensor 160 together with the air flowing into the first flow path A1 from the inside of the cooking chamber 20. Since the air flowing through the second flow path S2 is mixed with the air flowing through the first flow path A1, the temperature of the air that passes through the sensor 160 may be lower than the temperature in the cooking chamber. Accordingly, the sensor 160 may be protected from direct heat by lowering the temperature of the air that flows by passing through the sensor 160.

Both the air in the cooling chamber 20 that is discharged to the exhaust pipe 120 and the air flowing into the inlet 210 may be discharged to the second passage part S2 through the outlet 230. According to the continuous equation of fluid, a sum of the amount of air in the cooking chamber 20 flowing into the first passage part S1 and the amount of air flowing into the inlet 210 of the air of the second passage part S2 may be the same as the amount of air discharged to the second passage part S2 through the outlet 230. In addition, the amount of air discharged to the second passage part S2 through the outlet 230 may be maintained to a certain amount. Therefore, as the amount of air flowing into the first passage part S1 through the inlet 210 of the air of the second passage part S2 increases, the amount of air flowing into the first passage part S1 through the exhaust pipe 120 of the air in the cooking chamber 20 may be relatively reduced. On the contrary, as the amount of air flowing into the first passage part S1 through the inlet 210 of the air of the second passage part S2 is reduced, the amount of air flowing into the first passage part S1 through the exhaust pipe 120 of the fluid in the cooking chamber 20 may relatively increase. However, when the inlet 210 is closed, the amount of air discharged to the second passage part S2 through the outlet 230 may be the same as the amount of air in the cooking chamber that is discharged through the exhaust pipe 120.

The amount of air flowing through the inlet 210 may be controlled by adjusting a cross-section of the inlet 210, the position of the inlet 210 in the partition 200, or the space between the partition 200 and the second duct 300. The amount of air discharged from the side of the cooking chamber 20 may be controlled by adjusting the amount of air flowing into the inlet 210.

Since the speed of air flowing through the second passage part S2 is greater than the speed of air flowing through the first passage part S1, the pressure drop may occur near the outlet 230, and the air flowing through the third flow path A3 may be discharged to the second passage part S2 through the outlet 230. The air discharged to the outlet 230 may be discharged to the outside through the main outlet 330 together with the air flowing through the second passage part S2.

The second passage part S2 may be formed by vertically combining the second duct 300 with the partition 200. The second passage part S2 may have a portion adjacent to the outlet 230 that is narrower than a portion adjacent to the inlet 210, and the cross section of the second passage part S2 may gradually decreases from the inlet 210 toward the outlet 230.

The second passage part S2 may have a portion where a space between the second duct 300 and the partition 200 is narrowed and a portion where a space between the second duct 300 and the partition 200 is maintained to be uniform in a vertical direction. The height of the second passage part S2 may be reduced by at least one of a first inclined surface 201 where the inlet 210 of the partition 200 is inclined downwardly toward one side or a second inclined surface 301 where a portion of the second duct 300 corresponding to the inlet 210 is inclined upwardly toward one side. In addition, the height of the second passage part S2 may be kept substantially same by a first flat surface of the partition 200 and a second flat surface 303 of the second duct 300.

The second passage part S2 may include a main inlet 301 into which external air is forcibly suctioned, and a main outlet 330 thorough which air transferred from the first and second passages parts S1 and S2 is discharged. The blowing fan 500 may be provided in the main inlet 301 and the air suctioned into the second passage part S2 through the main inlet 301 by the blowing fan 500 may be gradually accelerated by passing through a portion where the height of the second passage part S2 is reduced and then discharged to the outside through the main outlet 330.

The partition 200 may be penetrated to form the inlet 210 and the outlet 230.

The inlet 210 may allow part of air flowing through the second passage part S2 to flow into the first passage part S1. When the inlet 210 is opened, air may flow into the inlet 210 and pass through the sensor 160, and the air flowing into the inlet may lower the temperature in the first passage part S1.

The outlet 230 may allow air flowing through the first passage part S1 to be discharged to the second passage part S2. The outlet 230 may include a guide member 233 bent inwardly toward the second passage part S2, and the cross-section of the second passage part S2 may be narrowed and then widened at a position where the outlet 230 is disposed by the guide member 233. The air pressure may be low and the flowing speed may be high in the upstream of the guide member 233, which is relatively narrow, and the air pressure may be high and the flowing speed may be low in the downstream of the guide member 233, which is relatively wider. Therefore, the air of the first passage part S1 may be discharged through the outlet 230.

The inlet 210 may be formed at a portion where the height of the second passage part S2 is reduced, and the outlet 230 may be formed at one end of a parallel unit. The outlet 230 may be formed at a portion where the height of the second passage part S2 is uniform to maintain the amount of air discharged to the second passage part S2 through the outlet 230 to be within a certain range. In other words, since a space between the second duct 300 and the partition 200 at a position where the outlet 230 is disposed remains uniform, the amount of air discharged through the outlet 230 may be maintained within a certain range.

Figure 7:
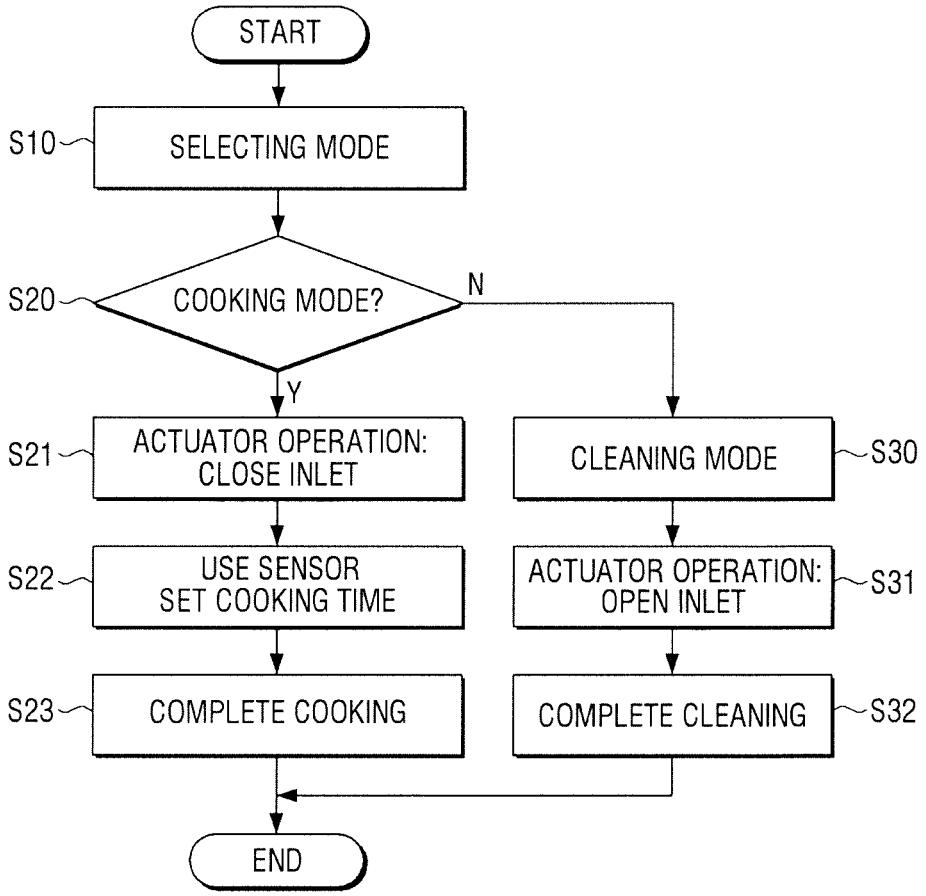
FIG. 7 is a flowchart illustrating a controlling process of an oven according to an embodiment of the present disclosure.

FIG. 7 is a flowchart illustrating a controlling process of an oven according to an embodiment of the present disclosure.

The operation of the oven 1 may be a cooking mode S20 and a cleaning mode S30. At the cooking mode S20, the food may be automatically cooked by using the sensor 160. At the cleaning mode S30, pyrolytic cleaning may be performed for removing impurities such as oil sludge, stains, etc. in the cooking chamber 20 generated at the time of cooking food with high temperature heat. At the cleaning mode S30, the temperature of the cooking chamber may rise above 300° C.

Referring to FIG. 7, an operation mode of an oven may be selected by a user at step S10.

When a user selects the cooking mode at step S20, the inlet 210 may be closed at step S21. The opening and closing member 365 may be downwardly moved by the operation of the actuator 360 to close the inlet 210, and external air flowing into the inlet 210 may be blocked. The food may be automatically cooked by selecting a cooking time by using the sensor 160 disposed in the first passage part S1 at step S22. Only the air in the cooking chamber which is discharged through the exhaust pipe 120 may flow through the first passage part S1 by closing the inlet 210. Accordingly, the sensor 160 may sense only the air from the food in the cooking chamber 20, and provide optimal environment for determining the cooking condition of the food. When cooking is completed at step S20, the operation of the oven 1 may be completed.

When the user selects the cleaning mode at step S30, the inlet 210 may be opened at step S31. The opening and closing member 365 may be upwardly moved by the operation of the actuator 360 and open the inlet 210. The external air may flow into the first passage part S1 through the inlet 210. The sensor 160 may not be used at the cleaning mode S30, but the operation be performed at a high temperature at the cleaning mode S30. Therefore, the temperature of air flowing through the sensor 160 may be lowered by opening the inlet 210 to protect the sensor 160 from the high temperature air discharged from the cooking chamber 20. In other words, when cleaning is completed at step S32, the operation of the oven 1 may be completed.

The inlet 210 may be closed so that the sensor 160 may sense the cooking condition of the food with only air discharged from the cooking chamber 20 at the cooking mode S20 where the temperature is relatively low, and the inlet 210 may be opened so that hot air in the cooking chamber 20 may not be in direct contact with the sensor but may be mixed with the air flowing through the inlet 210 to allow air at a lower temperature than a temperature of the cooking chamber to contact the sensor at the cleaning mode S30 where the temperature is relatively high, thereby protecting a heat sensitive sensor. Thus, the life of the sensor may be increased with such structure.

At the cooking mode S20, the inlet 210 may be closed, and the air in the cooking chamber 20 may flow into the first duct 100, and pass through the sensor 160 to be discharged to the outlet 230. At the cleaning mode at step S30, the inlet 210 may be opened, and air flowing from the second duct 300 into the first duct 100 through the inlet 210 and air flowing from the inside of the cooking chamber 20 into the first duct 100 may be discharged to the outlet 230 through the sensor 160.

The oven control process according to the present disclosure may include at least one of the above-described modes, some of modes may be omitted, or other modes may be further included. Operations performed by the oven control process according to the present disclosure may be performed in a sequential, parallel, repetitive, or heuristic manner. Also, some operations may be performed in a different order, omitted, or other operations may be added.

It is described that the sensor 160 is fixed to the first passage part S1, but the present disclosure is not limited thereto. As described below, it is clearly understood the sensor 160 can selectively move to the first and second passage parts S1 and S2.

Figure 8A:
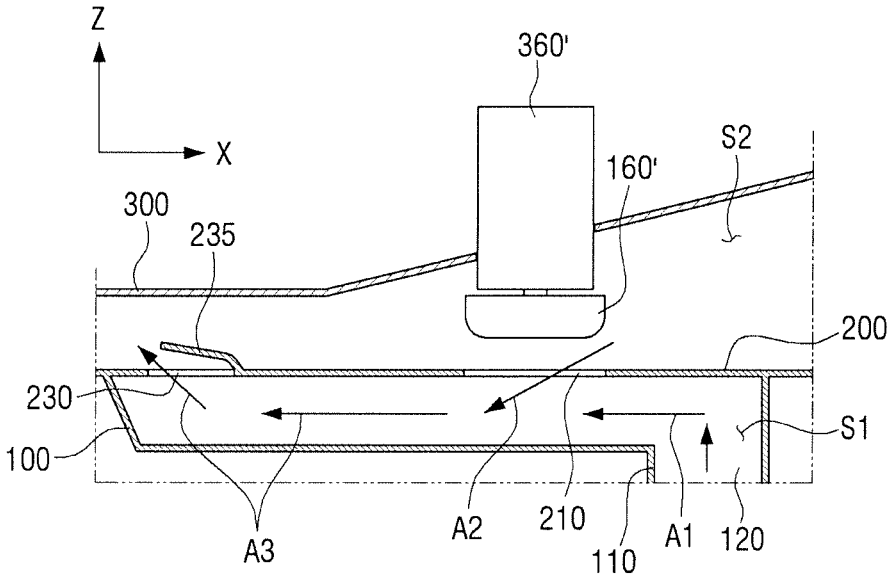
FIGS. 8A and 8B are views illustrating an operation of a sensor provided in an oven according to an embodiment of the present disclosure.
Figure 8B:
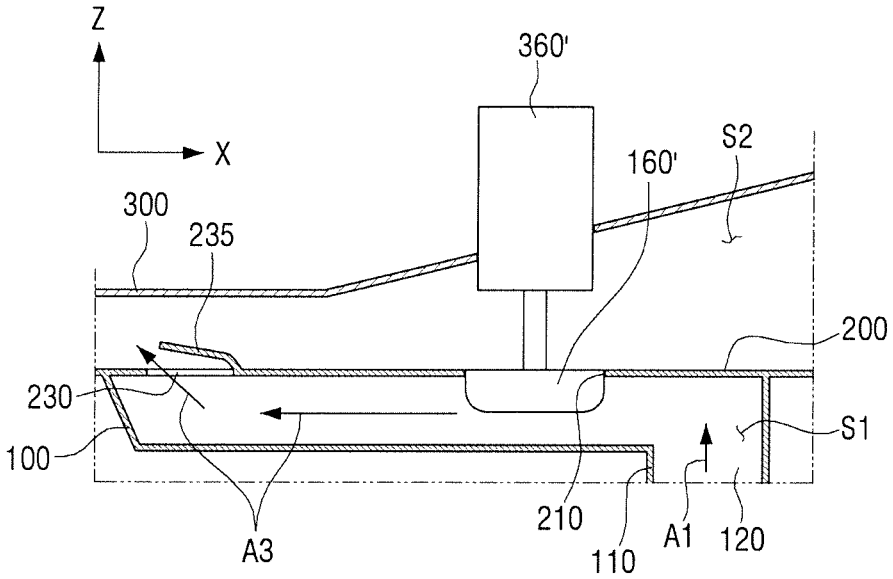

FIGS. 8A and 8B are views illustrating an operation of a sensor provided in an oven according to an embodiment of the present disclosure.

Referring to FIGS. 8A and 8B, a sensor 160' may be combined with one end of an actuator 360'. The sensor 160' may be movably arranged to at least one of the first and second passage parts S1 and S2 by the operation of the actuator 360'. The inlet 210 may be opened or closed by moving the sensor 160' upwardly and downwardly.

At the cleaning mode at step S30, the sensor 160' may move into the second passage part S2 and the inlet 210 may be opened. The air flowing into the first duct 100 from the second duct 300 through the open inlet 210 may be discharged to the outlet 230 together with the air flowing into the first duct 100 from the inside of the cooking chamber 20. At the cleaning mode at step S30, the sensor 160' may not be used. Thus, the sensor 160' may not need to be arranged in the first passage part S1.

The sensor 160' may move into the first passage part S1 and close the inlet 210 at the cooking mode at step S20. The air in the cooking chamber 20 may flow into the first duct 100, and pass through the sensor 160' to be discharged to the outlet 230. The sensor 160' may be positioned in the first passage part S1 to sense the air discharged from the cooking chamber 20 at the cooking mode S20.

When the sensor 160' is variably positioned in the first passage part S1 or the second passage part S2, the sensor 160' may be exposed to the air in the cooking chamber 20 only at the cooking mode S20 that uses the sensor 160', and may not be exposed at the cleansing mode S30. The sensor 160' disposed in the second passage part S2 at the cleansing mode S30 may maintain durability for not being exposed to high temperature air and the malfunction of the sensor 160' may be prevented in advance.

While the present disclosure has been particularly shown and described with reference to embodiments thereof, it is to be understood that the disclosure is not limited to the embodiments. The configuration and operation of each embodiment may be implemented in combination with at least one other embodiment.

The various embodiments described above may be implemented in a recording medium that can be read by a computer or a similar device using software, hardware, or a combination thereof. In some cases, embodiments described herein may be implemented by processor 120 itself. According to software implementation, embodiments such as the procedures and functions described herein may be implemented in separate software modules. Each of the software modules may perform one or more of the functions and operations described herein.

Meanwhile, computer instructions for performing the processing operations of the sound output apparatus 100 according to various embodiments of the present disclosure described above may be stored in a non-transitory computer-readable medium. The computer instructions stored in the non-volatile computer-readable medium cause a specific apparatus to perform the processing operations in the sound output apparatus 100 according to the various embodiments described above when executed by the processor of the specific apparatus.

The non-transitory computer readable recording medium may refer to a medium that stores data and that can be read by devices. In detail, the aforementioned various applications or programs may be stored in the non-transitory computer readable medium, for example, a compact disc (CD), a digital versatile disc (DVD), a hard disc, a Blu-ray disc, a universal serial bus (USB), a memory card, a read only memory (ROM), and the like, and may be provided.

Although embodiments have been shown and described, it will be appreciated by those skilled in the art that changes may be made to these embodiments without departing from the principles and spirit of the present disclosure. Accordingly, the scope of the present disclosure is not construed as being limited to the described embodiments, but is defined by the appended claims as well as equivalents thereto.

DRAWINGS

FIG. 7
START
S10 SELECTING MODE
S20 COOKING MODE?
S21 ACTUATOR OPERATION: CLOSE INLET
S22 USE SENSOR: SET COOKING TIME
S23 COMPLETE COOKING
S30 CLEANING MODE
S31 ACTUATOR OPERATION: OPEN INLET
S32 COMPLETE CLEANING
END

What is claimed is:

1. An oven, comprising:
a cooking chamber;
a first passage part arranged outside the cooking chamber and coupled to receive air discharged from an outlet of the cooking chamber;
a sensor arranged in the first passage part; and
a second passage part separated from the first passage part by a partition, and through which forcibly suctioned external air is transferred;
the partition having an inlet and an outlet configured to selectively couple the first and second passage parts, such that based on the inlet being closed, air in the cooking chamber flows into the first passage part, and then passes the sensor to be discharged through the outlet of the partition, and based on the inlet being opened, air flowing from the second passage part into the first passage part through the inlet passes the sensor to be discharged through the outlet of the partition together with the air from the cooking chamber which flows into the first passage part from the outlet of the cooking chamber.

2. The oven as claimed in claim 1, wherein the second passage part has a portion adjacent to the outlet of the partition that is narrower than a portion adjacent to the inlet of the partition.

3. The oven as claimed in claim 1, wherein a cross-section of the second passage part gradually decreases from the inlet of the partition towards the outlet.

4. The oven as claimed in claim 1, wherein the inlet of the partition comprises a main inlet into which external air is forcibly suctioned, and the outlet of the partition comprises a main outlet through which air transferred from the first and second passage parts is discharged.

5. The oven as claimed in claim 4, wherein the main inlet is mounted with a blowing fan.

6. The oven as claimed in claim 1, wherein the sensor is disposed downstream of the cooking chamber outlet which discharges air from the cooking chamber or the inlet of the partition on an air flow path along the first passage part.

7. The oven as claimed in claim 6, wherein the outlet of the partition is disposed downstream of the sensor on the air flow path along the first passage part.

8. The oven as claimed in claim 1, further comprising:
an opening and closing member configured to open and close the inlet of the partition; and
an actuator configured to drive the opening and closing member.

9. The oven as claimed in claim 8, wherein an area of the inlet of the partition is smaller than an area of the outlet of the partition.

10. The oven as claimed in claim 1, wherein the sensor is movably disposed to one of the first and second passage parts.

11. The oven as claimed in claim 10, wherein the sensor is configured to open and close the inlet of the partition.

12. The oven as claimed in claim 1, wherein the first passage part is formed between a first duct and the partition, and wherein the second passage part is formed between a second duct and the partition.

13. The oven as claimed in claim 12, wherein the partition is such that a portion including the inlet of the partition is inclined downwardly to one side.

14. An oven, comprising:

a cooking chamber;

a first duct arranged outside the cooking chamber and coupled to an outlet of the cooking chamber;

a sensor arranged in the first duct;

a partition coupled to the first duct, the partition including an inlet into which external air flows, and an outlet which discharges air in the first duct; and a second duct coupled to the partition, the second duct including a main inlet into which external air is forcibly suctioned, and a main outlet which discharges internal air, wherein air in the cooking chamber flows into the outlet of the cooking chamber, into the first duct, and passes the sensor to be discharged through the outlet of the partition in a cooking mode, and passes the sensor to be discharged through the outlet of the partition together with air flowing into the first duct from the second duct through the inlet in a cleaning mode.

15. The oven as claimed in claim 14, wherein the sensor is disposed in a space through which air from the outlet of the cooking chamber and air flowing from the inlet of the partition flow together.

16. An oven, comprising:

a cooking chamber;

a first passage part arranged outside the cooking chamber and tunneled with the cooking chamber;

a second passage part separated from the first passage part, and through which forcibly suctioned external air is transferred;

a sensor movably disposed to one of the first and second passage parts; and an inlet and an outlet configured to allow the first and second passage parts to be tunneled with each other, wherein based on the inlet being closed, air in the cooking chamber flows into the first passage part, and then passes through the sensor to be discharged through the outlet, and based on the inlet being opened, air flowing from the second passage part into the first passage part through the inlet passes through the sensor to be discharged through the outlet together with the air in the cooking chamber which flows into the first passage part.

* * * * *